United States Patent [19]

LaCroce et al.

[11] 4,044,915

[45] Aug. 30, 1977

[54] CONTAINER END CLOSURE

[75] Inventors: Leonard Thomas LaCroce, Paramus; Charles Stephan Radtke, Little Ferry, both of N.J.

[73] Assignee: American Can Company, Greenwich, Conn.

[21] Appl. No.: 707,533

[22] Filed: July 22, 1976

[51] Int. Cl.[2] ..... B65D 41/32

[52] U.S. Cl. ..... 220/270; 220/271

[58] Field of Search ..... 220/267–273, 220/90.6

[56] References Cited

U.S. PATENT DOCUMENTS 3,891,117 6/1975 Dragomier et al. ..... 220/270

3,951,299 4/1976 Khoury ..... 220/271

*Primary Examiner*—George T. Hall

*Attorney, Agent, or Firm*—Robert P. Auber; Ira S. Dorman; Thomas M. Galgano

[57] ABSTRACT

A full panel, easy-open container end closure includes a double-folded band formed in the removable panel adjacent the peripheral score, and an opening tab having a nose portion disposed adjacent the peripheral score and band. The tab is secured to a hinge section defined in the removable panel by a rupturable, bowed, generally U-shaped ancillary score which is disposed with its two ends adjacent the band and tab nose portion. This construction effectively reduces the intial rearward force required to effect panel removal.

10 Claims, 8 Drawing Figures

CONTAINER END CLOSURE

BACKGROUND OF THE INVENTION

End closures for cans and other containers and, more specifically, those of the so-called "easy-open" type are, of course, well known in the art. Typically, they include an end wall having a removable panel defined therein by a rupturable primary score which, upon severance and removal of the panel, provides a dispensing aperture. Generally, score rupture and panel removal are both effected by use of a pull tab having a nose portion at one end and a handle portion at its opposite end. The tab is so mounted on the panel as to be pivotable into contact adjacent the score, so as to initiate severance thereof, and to thereafter facilitate tearing of the panel away from the remainder of the end wall.

Often, the removable panel has formed therein a rupturable ancillary score which is employed to facilitate pivoting of the tab and score initiation and, in the case of a container under pressure or vacuum, to afford initial venting. As typified by the can end closure construction illustrated in U.S. Pat. No. 3,863,801, such an ancillary or "moustache" score is formed in the removable panel so that it passes inwardly of the tab securing means and extends generally laterally therefrom. However, this score configuration has been found generally unsuitable for a can end closure of the type which has a double-folded band formed in the removable panel adjacent the primary score to afford raw edge protection (see, for example, the can end closure described in U.S. Pat. No. 3,696,961). While moustache scores are satisfactory in terms of facilitating tab pivoting, score initiation and initial venting, their utilization causes a relatively large portion of the panel, i.e., the panel area defined between the primary and ancillary scores, to be pivoted downwardly upon manipulation of the tab to effect rupture initiation of the primary score. This, in turn, tends to produce a relatively long arc of initial score severance as a result of which the initial rearward force applied (to effect continued tearing of the score) will be distributed over an extended area of the panel. This reduces the effectiveness of the initial tear force applied and, in turn, necessitates the use of an undue amount of effort to effect panel removal.

In addition, the downward pivoting of a relatively large portion of the panel can be an extremely undesirable feature where the closure is used on containers for foodstuffs, such as puddings and the like, since the bent panel portion will function as a scoop, carrying some of the packed product with it as it is detached from the can. Not only is it aesthetically unpleasing and a cause of splattering, but it also poses a potential safety hazard, particularly to young children, since it entices them to lick the product off the severed panel. Although the panel may be provided with a "safety" edge, i.e., the double-folded band, the raw edge of the panel cannot be entirely shielded, and so some possibility of potential injury would generally exist.

Accordingly, it is an object of this invention to provide a novel can end closure which affords desirable opening characteristics and maximizes the effectiveness of the applied, initial rearward tearing force.

It is also an object of this invention to provide such a novel container end closure which also minimizes potential safety hazards to consumers and eliminates the problem of product pickup on the detached panel.

It is a further object of this invention to provide such a novel container end closure which is simple, highly effective, and of relatively inexpensive construction.

It is a more particular object of this invention to provide a novel container end closure of the "easy-open" type having the foregoing attributes and characteristics.

SUMMARY OF THE INVENTION

It has now been found that the foregoing and related objects are readily attained in a container end closure which includes a wall having an at least partially removable panel defined therein by a rupturable primary score, which panel has formed therein at least a portion of a double-folded band adjacent the primary score; an opening tab having a nose portion at one end and a handle portion at its other end; and means for securing the tab, intermediate the end portions thereof, to the outer surface of the panel, so that the nose portion is disposed adjacent the primary score and the band portion. A hinge section is defined in the panel by a rupturable, generally U-shaped ancillary score which is disposed about the securing means with its two ends adjacent the band and the nose portion of the tab. Lifting of the tab handle portion will fracture the ancillary score and elevate the hinge section, while forcing the nose portion thereof downwardly to initiate rupture of the primary score, following which rearward force on the tab will cause further rupture of the primary score and thereby permit at least partial removal of the panel.

Preferably, the ancillary score is bowed and the panel is completely removable. The primary score may advantageously be disposed adjacent the periphery of the wall and, most desirably, the closure, the wall and the primary score are generally circular. In the particularly preferred embodiments, the securing means is a rivet formed integrally with the panel and the folded band is coextensive with the primary score and is disposed on the outer surface of the panel. Finally, the closure is fabricated from metal.

DETAILED DESCRIPTION OF THE ILLUSTRATED EMBODIMENT

Figure 4:
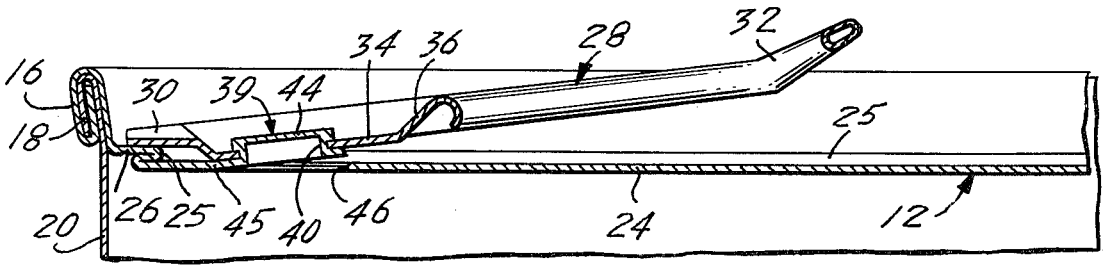
FIG. 4 is a view comparable to that of FIG. 3, showing the can end closure attached to a can body by means of a double seam, and showing the pull tab pivoted to an initial position at which rupture of the ancillary score has been effected and rupture of the peripheral score is imminent.
Figure 5:
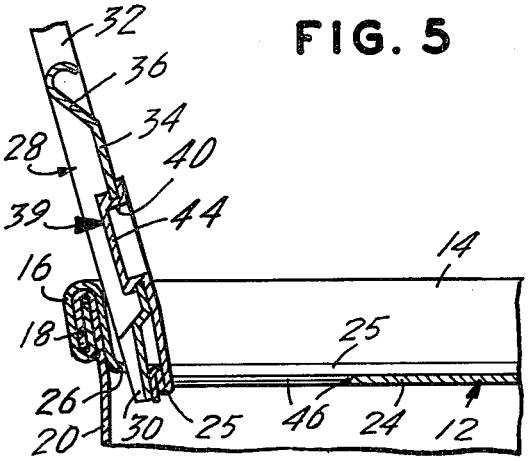
FIG. 5 is a view similar to that of FIG. 4, showing the pull tab further pivoted, at which position rupture of the peripheral score has been initiated.
Figure 8:
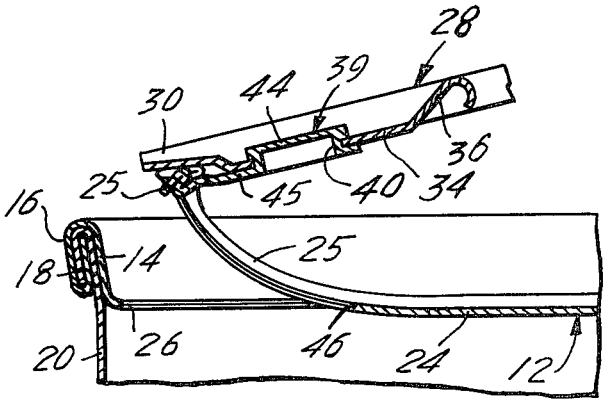
FIG. 8 is a fragmentary, cross-sectional view comparable to that of FIGS. 4 and 5, showing the pull tab rearwardly displaced and effecting further removal of the central panel.

Turning now in detail to the appended drawings, therein illustrated is a can end closure embodying the present invention and including a substantially flat, circular end wall, generally designated by the numeral 12, which is joined by a countersink wall 14 to a curled, circumferential flange 16. The flange 16 is adapted to be interfolded with flange 18 at the end of can body 20 to form a double seam, as shown in FIGS. 4, 5 and 8. The end wall 12 has a removable panel 24 defined therein by a rupturable primary or peripheral score 26, which is formed adjacent the countersink wall 14 and encompasses substantially the entire end wall 12, thus defining a full panel opening feature therein. The panel 24 includes a three-ply, annular, double-folded band 25 which is disposed adjacent the peripheral score 26 and on the outer surface of the panel 24.

Figure 1:
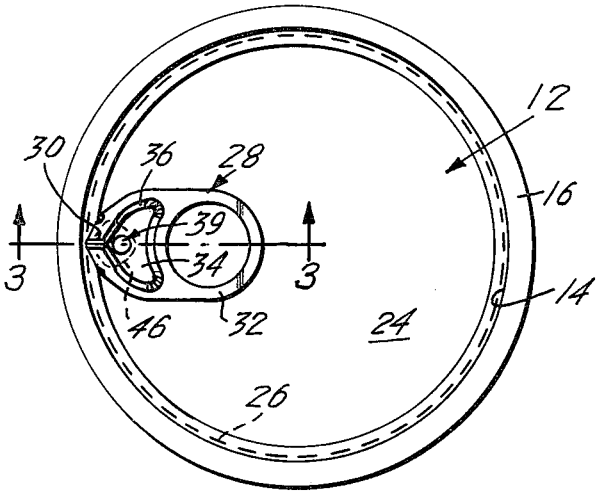
FIG. 1 is a plan view of a can end closure embodying the present invention.
Figure 2:
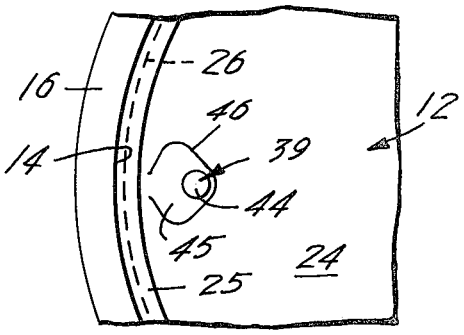
FIG. 2 is an enlarged, fragmentary view of the operative portion of the can end closure of FIG. 1, with the pull tab removed to show the ancillary score formed in the removable panel thereof.
Figure 3:
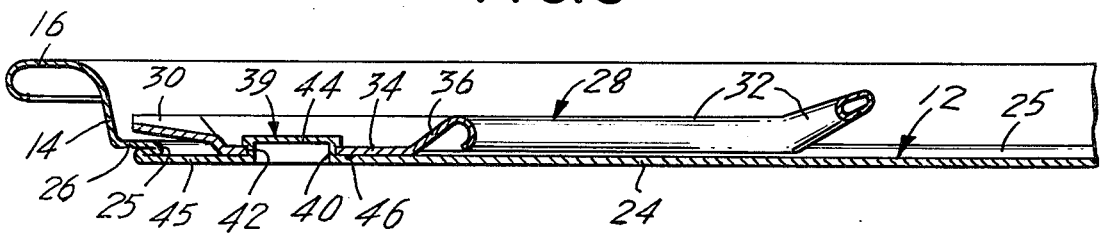
FIG. 3 is a fragmentary, cross-sectional view along line 3—3 of FIG. 1, drawn to a further enlarged scale from that of FIG. 2.
Figure 6:
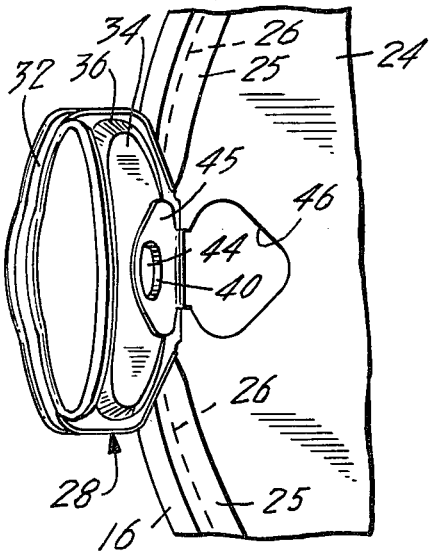
FIG. 6 is a fragmentary, plan view of the operative portion of the end of the foregoing figures, showing the pull tab in the position of FIG. 5.

An opening tab, generally designated by the numeral 28, has a nose portion 30 at one end, a gripping ring or handle portion 32 at its other end, and a generally triangular, depressed web portion 34 located therebetween and joined thereto by a peripheral shoulder portion 36, the latter having a hole 42 formed therethrough. The tab 28 is secured to the removable panel 24 by a rivet, generally designated by the numeral 39, which is integrally formed in the panel 24 and comprises an upstanding cylindrical shank portion 40, extending through the hole 42 of the web portion 34, and a head portion 44, extending thereover and bearing tightly thereon. The tab 28 is so positioned that its nose portion 30 lies over the peripheral score 26. As best illustrated in FIGS. 2 and 6, a hinge section 45 is defined in the removable panel 24 by a bowed, generally U-shaped ancillary score 46 formed about the shank portion 40 of the rivet 39, with its two ends terminating adjacent the double-folded band 25 and nose portion 30 of the tab 28.

Referring now to FIG. 4, upon lifting of the tab handle portion 32 the ancillary score 46 ruptures, thus facilitating further pivotal movement of the tab 28 and (in the case of a container under pressure or vacuum) affording initial venting. Continued lifting of the handle 32 elevates the hinge section 45 out of the plane of the panel 24 and brings the tip of the nose portion 30 of the tab 28 into contact with the panel 24, at or closely adjacent the primary score 26, to initiate its rupture. As depicted in FIG. 8, following initial rupture of the primary score 26, a rearward force is applied on the tab handle 32 to effect continued tearing of the primary score, and eventually complete removal of the panel 24 to fully open the can.

It should be especially emphasized that the displacement of the hinge section 45 greatly reduces the initial rearward tear force necessary to effect panel removal; a factor which tends to be of critical importance in the case of can end closures of the type illustrated (i.e., those having double-folded band protection), since they typically require higher initial rearward tear forces to effect panel removal. This reduction in tear force is a result of the combined effects of (1) maximizing the effectiveness of subsequent rearward tearing force by minimizing the length of the chordal section over which it is applied, i.e., between the ends of the ancillary score 46, and (2) laterally weakening the panel 24 by removal of the hinge section, the area of which section is maximized by the bowed configuration of the ancillary score 46.

Figure 7:
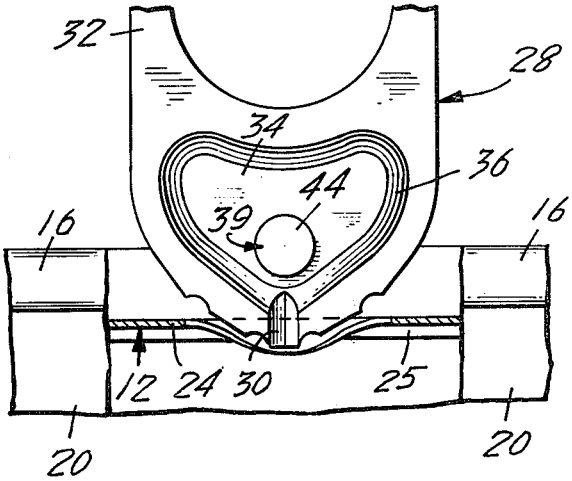
FIG. 7 is a fragmentary, front view of the end closure, with a portion of the sidewall of the can broken away to show the condition of the panel with the tab in the position of FIGS. 5 and 6.

It should also be appreciated that, as a result of the ancillary score configuration, only a relatively small arc of the score 26 is initially ruptured, and that this arc of severance is confined substantially between the ends of the ancillary score 46. As a result, and as is seen best in FIG. 7, only the marginal portion of the annular, double-folded band 25 lying immediately beneath the nose portion 30 of the tab 28 is bent downwardly; as is readily apparent, relative to the potential problem of food pickup, this amount of downward deflection is insignificant. It should also be pointed out that the annular, double-folded band 25, in addition to serving to shield the raw edge of the panel 24 after it is removed, prevents the ancillary score 46 from tearing through to the primary score 26 and, thereby, prevents the tab from disengagement from the panel 24.

While the instant can end closure has been described in relation to the illustrated and preferred embodiment it should be understood that modifications may be made, as will be apparent to those skilled in the art. For instance, the end closure embodied by the instant invention may be employed with variously-configured containers and cans, which need not be circular as shown. Additionally, although the end closure illustrated in the drawings is of the "full-panel, easy-open" type, in which the primary score defines a completely removable panel encompassing substantially the entire end wall, the primary score may, instead, define a panel which is only partially removable and/or define a removable panel which constitutes only a portion of the end wall. It should also be noted that, while a complete annular, double-folded band is desirable for safety reasons, it is only essential that a portion of the double-folded band be disposed adjacent the ends of the ancillary score, so as to prevent the ancillary score from tearing through the edge of the panel to the primary score. In addition, although it is preferred that the band be disposed on the outer surface of the panel, instead, it may possibly be disposed on its inner surface. Also, while it is most desirable for the U-shaped ancillary score to be bowed, it may possibly be advantageously employed without this feature. Finally, it should be appreciated that the can end closure may be fabricated from any rupturable material conventionally employed for end closures of this type, albeit that steel or aluminum will normally be employed.

Thus, it can be seen that the present invention provides a novel container end closure which affords desirable opening characteristics, and maximizes the effectiveness of the applied initial rearward tearing force. The closure minimizes the potential safety hazards to consumers and eliminates the problem of product pickup on the detached panel; it is simple, highly effective and of relatively inexpensive construction. In particular, the invention provides a novel container end closure of the "easy-open" type, having the foregoing attributes and characteristics.

What is claimed is:

1. A container end closure comprising: a wall having an at least partially removable panel defined therein by a rupturable primary score, said panel having formed therein at least a portion of a double-folded band adjacent said primary score; an opening tab having a nose portion at one end and a handle portion at its other end; means for securing said tab, intermediate said end portions thereof, to the outer surface of said panel, so that said nose portion is disposed adjacent said primary score and said band portion; and a hinge section defined in said panel by a rupturable, generally U-shaped ancillary score, the loop portion of said ancillary score being disposed about said securing means with its two leg portions having end regions presented toward and terminating adjacent said band portion and said nose portion of said tab, so that lifting of said handle portion of said tab is operative to rupture said ancillary score through a region terminated by said band and elevate said hinge section while forcing said nose portion thereof downwardly to initiate rupture of said primary score, subsequent rearward force on said tab causing further rupture of said primary score to effect at least partial removal of said panel.

2. The closure of claim 1 wherein said generally U-shaped ancillary score is bowed so that said leg portions are divergent toward a region intermediate said means for securing said tab and said primary score, and convergent from said intermediate region toward the recited end regions thereof.

3. The closure of claim 1 wherein said panel is completely removable.

4. The closure of claim 3 wherein said primary score is disposed adjacent the periphery of said wall.

5. The closure of claim 4 wherein said closure, said wall and said primary score are generally circular, and the recited initial rupture of the primary score by said nose portion defines an arc confined substantially between said end regions of said ancillary score.

6. The closure of claim 1 wherein said securing means is a rivet formed integrally with said panel.

7. The closure of claim 1 wherein said band is coextensive with said primary score.

8. The closure of claim 1 wherein said band is disposed on the outer surface of said panel.

9. The closure of claim 1 wherein said closure is fabricated from metal.

10. A container end closure comprising: a wall having a removable panel defined therein by a rupturable primary score disposed adjacent the periphery of said wall, said panel having formed therein a double-folded band disposed on the outer surface thereof and adjacent said primary score; an opening tab having a nose portion at one end and a handle portion at its other end; a rivet formed integrally with said panel and securing said tab, intermediate said end portions thereof, to said outer surface of said panel, so that said nose portion is disposed adjacent said primary score and said band; and a hinge section defined in said panel by a rupturable, bowed, generally U-shaped ancillary score, said ancillary score having its loop portion disposed about said rivet with its two leg portions having generally convergent end regions presented toward and terminating adjacent said band and said nose portion of said tab, so that lifting of said handle portion of said tab is operative to rupture said ancillary score through a region terminated by said band and elevate said hinge section while forcing said nose portion thereof downwardly to initiate rupture of said primary score, subsequent rearward force on said tab causing further rupture of said primary score to effect complete removal of said panel.

* * * * *